US009898953B2

(12) United States Patent
Li et al.

(10) Patent No.: US 9,898,953 B2
(45) Date of Patent: Feb. 20, 2018

(54) OFFSET METHOD AND EQUIPMENT OF RGBW PANEL SUBPIXEL

(71) Applicant: Shenzhen China Star Optoelectronics Technology Co., Ltd., Shenzhen, Guangdong (CN)

(72) Inventors: Hao Li, Guangdong (CN); Ming-Jong Jou, Guangdong (CN); Shen-sian Syu, Guangdong (CN); Yufeng Jin, Guangdong (CN); Lin Li, Guangdong (CN); Ronggang Wang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 198 days.

(21) Appl. No.: 14/901,720

(22) PCT Filed: Sep. 21, 2015

(86) PCT No.: PCT/CN2015/090129
§ 371 (c)(1),
(2) Date: Dec. 28, 2015

(87) PCT Pub. No.: WO2017/045213
PCT Pub. Date: Mar. 23, 2017

(65) Prior Publication Data

US 2017/0263171 A1 Sep. 14, 2017

(30) Foreign Application Priority Data

Sep. 14, 2015 (CN) ..... 2015 1 0583005

(51) Int. Cl.
*G09G 5/02* (2006.01)
*G09G 3/20* (2006.01)

(52) U.S. Cl.
CPC ..... *G09G 3/2003* (2013.01); *G09G 3/2074* (2013.01); *G09G 2300/0443* (2013.01);
(Continued)

(58) Field of Classification Search
None
See application file for complete search history.

(56) References Cited

U.S. PATENT DOCUMENTS 7,369,140 B1 * 5/2008 King ..... G06T 15/503 345/421
9,171,491 B1 * 10/2015 Kwon ..... G09G 3/2003
(Continued)

*Primary Examiner* — Anh-Tuan V Nguyen
(74) *Attorney, Agent, or Firm* — Andrew C. Cheng

(57) ABSTRACT

The invention discloses an offset method and equipment of a RGBW panel subpixel. The method includes: inputting data of pixels based on RGB color space in an image; determining the most similar pixels of each of the pixels in the image according to the data of the pixels based on RGB color space; when the resolution of pixels is the same, converting the data of the pixels based on RGB color space to data of the pixels based on RGBW color space, determining data based on RGBW color space corresponding to the most similar pixels of the pixels; three fourths subsampling the pixels in the image according to the data of the pixels based on RGBW color space, the data based on RGBW color space corresponding to the most similar pixels of each of the pixels; outputting data of pixels in the image after being sampled.

11 Claims, 9 Drawing Sheets

(52) U.S. Cl.
CPC ..... *G09G 2300/0452* (2013.01); *G09G 2320/0295* (2013.01); *G09G 2340/06* (2013.01)

(56) References Cited

U.S. PATENT DOCUMENTS

| | | | | |
|---|---|---|---|---|
| 2004/0155980 | A1* | 8/2004 | Itoh | H04N 9/646 348/450 |
| 2005/0220360 | A1* | 10/2005 | Zaklika | H04N 1/409 382/275 |
| 2006/0012610 | A1* | 1/2006 | Karlov | G09G 5/28 345/613 |
| 2007/0159492 | A1* | 7/2007 | Lo | G09G 5/026 345/589 |
| 2007/0176948 | A1* | 8/2007 | Ben-David | G09G 3/2003 345/690 |
| 2009/0252411 | A1* | 10/2009 | Siddiqui | G06T 3/4015 382/167 |
| 2010/0259556 | A1* | 10/2010 | Inuzuka | G09G 3/3611 345/604 |
| 2012/0113219 | A1* | 5/2012 | Chang | H04N 13/0011 348/43 |
| 2013/0120472 | A1* | 5/2013 | Byun | G09G 5/02 345/690 |
| 2013/0278726 | A1* | 10/2013 | Muhammad | H04N 9/045 348/46 |
| 2016/0132999 | A1* | 5/2016 | Kwon | G06T 5/008 345/593 |

* cited by examiner

OFFSET METHOD AND EQUIPMENT OF RGBW PANEL SUBPIXEL

BACKGROUND

1. Technical Field

The invention relates to the field of display technology, and more particularly to an offset method of a RGBW panel subpixel and an equipment of the RGBW panel subpixel.

2. Description of the Related Art

LG Display creatively adds white (W) subpixels based on RGB to form RGBW 4K. Light transmittance of a RGBW 4K panel increases due to the addition of white subpixels, lightness of a panel is also 1.5 times as bright as a conventional RGB 4K panel.

With further study in a RGBW panel, simply extending the arrangement of RGB panel subpixels to achieve a stripe-RGBW arrangement gets the most of study and attention. Each pixel of a stripe-RGBW panel consists of four horizontally arranged subpixels, dimension of each subpixel is same as that of subpixels of a RGB panel with the same size. With the arrangement, number and size of subpixels maintain the same, however, number of pixels is cut to be three fourths of that of the original RGB panel, so that the real resolution of the entire screen is fallen by a quarter compared with a RGB panel with the same size. A subsampling algorithm needs to be programmed to compress four subpixels of RGBW in order to correctly display a RGBW four-channel image converted from a RGB three-channel image on a panel with the same number of subpixels. Conventional subsampling methods include a simple ¾ entire pixel level interpolation subsampling method and a simple ¾ subpixel offset method that only horizontally adjacent pixels are considered.

An image can be displayed on a RGBW panel according to the previous method, but without considering the color relationship among adjacent pixels, jagged edges and image details loss appear during display.

SUMMARY

The invention mainly provides an offset method of a RGBW panel subpixel and an equipment of the RGBW panel subpixel, which can solve resolution loss and jagged edges when the whole pixel is subsampled.

The proposal according to the invention to overcome the previous problem is: an offset method of a RGBW subpixel panel, including: inputting data of a pixel based on RGB color space in an image; determining the most similar pixel of each of the pixels in the image according to the data of the pixels based on RGB color space; converting the data of the pixels based on RGB color space to data of the pixels based on RGBW color space under the circumstances that resolution of pixels is the same to determination the data based on RGBW color space corresponding to the most similar pixels of the pixels; three fourths subsampling pixels in the image according to the data of the pixels based on RGBW color space, the data based on RGBW color space corresponding to the most similar pixels of each of the pixels; outputting data of pixels in the image after being sampled; the sequence of determining the most similar pixels of each of the pixels in the image according to the data of pixels based on RGB color space including: converting the data of pixels based on RGB color space to data of the pixels based on HSI color space; calculating similarity of each of the pixels and adjacent pixels according to the data of pixels based on HSI color space to achieve the most similar pixels of each of the pixels; the sequence of three fourths subsampling pixels in the image according to the data of pixels based on RGBW color space, the data based on RGBW color space corresponding to the most similar pixels of the pixels including: dividing pixels in the image in an order of each group consisting of four pixels; adjusting arrangement of 16 subpixels in each of the group, arrangement of the 16 pixels in each of the groups after adjustment is: RGBW, WRGB, BWRG, GBWR; three fourths subsampling the 16 subpixels of each of the groups according to the arrangement of the 16 subpixels of each of the group after adjustment, achieving arrangement of 4 three-channel subpixels of each of the group: RGB, WRG, BWR, GBW, when the pixel i is RGBW, a strategy for sampling is:

$$R_d(i) = P_r(i)$$
$$G_d(i) = G_o(i)$$
$$B_d(i) = B_o(i),$$

when the pixel i is WRGB, a strategy for sampling is:

$$W_d(i) = P_w(i)$$
$$R_d(i) = R_o(i)$$
$$G_d(i) = G_o(i),$$

when the pixel i is BWRG, a strategy for sampling is:

$$B_d(i) = P_b(i)$$
$$W_d(i) = W_o(i)$$
$$R_d(i) = R_o(i),$$

when the pixel i is GBWR, a strategy for sampling is:

$$G_d(i) = P_g(i)$$
$$B_d(i) = B_o(i)$$
$$W_d(i) = W_o(i),$$

$R_d(i)$, $G_d(i)$, $B_d(i)$ and $W_d(i)$ are respectively grey levels of the pixel i based on RGBW four channels on RGBW color space after being sampled, $R_o(i)$, $G_o(i)$, $B_o(i)$ and $W_o(i)$ are respectively grey levels of the pixel i based on RGBW four channels on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on RGBW color space corresponding to the most similar pixel of the pixel i, $R_o(i-1)$, $G_o(i-1)$, $B_o(i-1)$ and $W_o(i-1)$ are grey levels of the RGBW four channels on the RGBW color space based on the pixel i−1 before being sampled.

The $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$
$$P_w(i)=\max(W_s(i),W_o(i),W_o(i-1))$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

When the resolution of pixels is the same, the sequence that converting the data of the pixels based on data of RGB color space to the data of the pixels based on RGBW color space to determination data of the most similar pixels of the pixels corresponding to RGBW color space includes: determining a grey level $W_o(i)$ of the pixels based on white channels on RGBW color space, where $W_o(i)=D_{min}(i)$, i is a position of the pixel, $D_{min}(i)$ is the minimum value of grey levels of the pixel i based on RGB three channels on RGB color space; calculating a yield value M of RGB three channels on the pixel, where $$M = \frac{(W_o(i) + D_{max}(i))}{D_{max}(i)},$$

$D_{max}(i)$ is the maximum value of grey levels of the pixel i based on RGB three channels on RGB color space; determining grey levels $R_o(i)$, $G_o(i)$ and $B_o(i)$ of the pixel based on RGB three channels on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are grey levels of the pixel based on RGB three channels on RGB color space; determining data $R_s(i)$, $G_s(i)$, $B_s(i)$ and $W_s(i)$ based on RGBW color space corresponding to the most similar pixel of the pixel according to the most similar pixel of the pixel in the image.

To solve the technical obstacle above, another proposal according to the invention is: providing an offset method of a RGBW panel subpixel, including: inputting data of pixels based on RGB color space in an image; determining the most similar pixels of each of the pixels in the image according to the data of the pixels based on RGB color space; when the resolution of pixels is the same, converting the data of the pixels based on RGB color space to the data of the pixels based on RGBW color space to determination the data based on RGBW color space corresponding to the most similar pixels of the pixels; three fourths subsampling the pixels in the image according to the data of the pixels based on RGBW color space, the data based on RGBW color space corresponding to the most similar pixels of each of the pixels; outputting data of pixels in the image after being sampled.

The sequence of determining the most similar pixels of each of the pixels in the image according to the data of pixels based on RGB color space includes: converting the data of pixels based on RGB color space to data of the pixels based on HSI color space; calculating similarity of each of the pixels and adjacent pixels according to the data of the pixels based on HSI color space to achieve the most similar pixels of the each of the pixels.

The sequence of three fourths subsampling pixels in the image according to the data of pixels based on RGBW color space, the data based on RGBW color space corresponding to the most similar pixels of the pixels includes: dividing pixels in the image in an order of each group consisting of four pixels; adjusting arrangement of 16 subpixels in each of the groups, an arrangement of the 16 subpixels in each of the group after adjustment is: RGBW, WRGB, BWRG, GBWR; three fourths subsampling the 16 subpixels of each of the groups according to the arrangement of the 16 subpixels of each of the groups after adjustment, achieving arrangement of 4 three-channel subpixels of each of the groups: RGB, WRG, BWR, GBW, when the pixel i is RGBW, a strategy for sampling is:

$$R_d(i) = P_r(i)$$

$$G_d(i) = G_o(i)$$

$$B_d(i) = B_o(i),$$

when the pixel i is WRGB, a strategy for sampling is:

$$W_d(i) = P_w(i)$$

$$R_d(i) = R_o(i)$$

$$G_d(i) = G_o(i),$$

when the pixel i is BWRG, a strategy for sampling is:

$$B_d(i) = P_b(i)$$

$$W_d(i) = W_o(i)$$

$$R_d(i) = R_o(i),$$

when the pixel i is GBWR, a strategy for sampling is:

$$G_d(i) = P_g(i)$$

$$B_d(i) = B_o(i)$$

$$W_d(i) = W_o(i),$$

$R_d(i)$, $G_d(i)$, $B_d(i)$ and $W_d(i)$ are respectively grey levels of the pixel i based on RGBW four channels on RGBW color space after being sampled, $R_o(i)$, $G_o(i)$, $B_o(i)$ and $W_o(i)$ are respectively grey levels of the pixel i based on RGBW four channels on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are gray levels based on RGBW four channels on RGBW color space corresponding to the most similar pixel of the pixel i, $R_o(i-1)$, $G_o(i-1)$, $B_o(i-1)$ and $W_o(i-1)$ are grey levels of RGBW four channels on the RGBW color space based on the pixel i−1 before being sampled.

The $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1)),$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

When the resolution of pixels is the same, the sequence that converting the data of the pixels based on RGB color space to the data of the pixels based on RGBW color space, and determining the data of the most similar pixels of the pixels corresponding to RGBW color space includes: determining a grey level $W_o(i)$ of the pixels based on white channels on RGBW color space, wherein $W_o(i)=D_{min}(i)$, i is a position of the pixel, $D_{min}(i)$ is the minimum value of gray levels of the pixel i based on RGB three channels on RGB color space; calculating a yield value M of three channels RGB on the pixels, $$M = \frac{(W_o(i) + D_{max}(i))}{D_{max}(i)},$$

$D_{max}(i)$ is the maximum value of gray levels of the pixel i based on three channels RGB on RGB color space; determining grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are respectively grey levels of the pixel based on three channels RGB on RGB color space; determining data $R_s(i)$, $G_s(i)$, $B_s(i)$ and $W_s(i)$ based on RGBW color space corresponding to the most similar pixel of the pixel according to the most similar pixel of the pixel in the image.

To solve the technology problems above, another proposal according to the invention is: providing an offset equipment of a RGBW panel subpixel, the equipment including: an input module, applied to input data of pixels in an image based on RGB color space; a determination module, applied to determine the most similar pixels of each of the pixels in the image according to data of the pixels based on RGB color space; a conversion module, applied to convert data of the pixels based on RGB color space to data of the pixels based on RGBW color space when the resolution of pixels, so as to determine data based on RGBW color space corresponding to the most similar pixels of the pixels; a sample module, applied to three fourths subsample pixels in the image according to data of the pixels based on RGBW color space, data based on RGBW color space corresponding to the most similar pixels of each of the pixels; an output module, applied to output data of pixels in the image after being sampled.

The determination module includes: a conversion unit, applied to convert data of the pixels based on RGB color space to data of the pixels based on HSI color space; a first calculation unit, applied to calculate similarity of each of the pixels and adjacent pixels according to data of the pixels based on HSI color space to achieve the most similar pixels of the each of the pixels.

The sample module includes: a grouping unit, applied to divide pixels in the image in an order of each group consisting of four pixels in the RGBW color space; an adjustment unit, applied to adjust arrangement of 16 subpixels in each of the groups, an arrangement of the 16 pixels in each of the groups after adjustment is: RGBW, WRGB, BWRG, GBWR; a sample unit, applied to three fourths subsampling the 16 subpixels of each of the groups according to the arrangement of the 16 subpixels of each of the groups after adjustment, achieving arrangement of 4 three-channel subpixels of each of the groups: RGB, WRG, BWR, GBW, when the pixel i is RGBW, a strategy for sampling is:

$$R_d(i) = P_r(i)$$

$$G_d(i) = G_o(i)$$

$$B_d(i) = B_o(i),$$

when the pixel i is WRGB, a strategy for sampling is:

$$W_d(i) = P_w(i)$$

$$R_d(i) = R_o(i)$$

$$G_d(i) = G_o(i),$$

when the pixel i is BWRG, a strategy for sampling is:

$$B_d(i) = P_b(i)$$

$$W_d(i) = W_o(i)$$

$$R_d(i) = R_o(i),$$

when the pixel i is GBWR, a strategy for sampling is:

$$G_d(i) = P_g(i)$$

$$B_d(i) = B_o(i)$$

$$W_d(i) = W_o(i),$$

$R_d(i)$, $G_d(i)$, $B_d(i)$ and $W_d(i)$ are respectively gray levels of the pixel i based on four channels RGBW on RGBW color space after being sampled, $R_o(i)$, $G_o(i)$, $B_o(i)$ and $W_o(i)$ are respectively gray levels of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels based on RGBW four channels on RGBW color space corresponding to the most similar pixel of the pixel i, $R_o(i-1)$, $G_o(i-1)$, $B_o(i-1)$ and $W_o(i-1)$ are grey levels of RGBW four channels on the RGBW color space based on the pixel i−1 before being sampled.

The $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1))$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$ $\max(W_s(i), W_o(i), W_o(i-1))$ is the maximum value in $W_s(i)$, $W_o(i)$ and $W_o(i-1)$ $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

The conversion module includes: a first determination unit, applied to determine a grey level $W_o(i)$ of the pixel based on white channels on RGBW color space, where $W_o(i)=D_{min}(i)$, i is a position of the pixel, $D_{min}(i)$ is the minimum value of grey levels of the pixel i based on three channels RGB on RGB color space; a second calculation unit, applied to calculate a yield value M of three channels RGB on the pixels, where $$M = \frac{(W_o(i) + D_{max}(i))}{D_{max}(i)},$$

$D_{max}(i)$ is the maximum value of grey levels of the pixel i based on three channels RGB on RGB color space; a second determination unit, applied to determine grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are grey levels of the pixel based on three channels RGB on RGB color space respectively; a third determination unit, applied to determine data $R_s(i)$, $G_s(i)$, $B_s(i)$ and $W_s(i)$ based on RGBW color space corresponding to the most similar pixel of the pixel according to the most similar pixel of the pixel in the image.

Advantages of the invention are: distinguishing from the conventional technique, the most similar pixels of each of the pixels in an image are pre-determined according to the invention, when pixels in an image are three fourths subsampled, influence factors include the data of pixels based on RGBW color space as well as the data based on RGBW color space corresponding to the most similar pixels of each of pixels, therefore, resolution loss and jagged edges can be fixed accordingly.

BRIEF DESCRIPTION OF THE DRAWINGS

FIG. 7 is a schematic view of an image from a first comparative test of the offset method of a RGBW panel subpixel according to the invention.

FIG. 8 is a schematic view of an image from a second comparative test of the offset method of a RGBW panel subpixel according to the invention.

FIG. 9 is a schematic view of an image from a third comparative test of the offset method of a RGBW panel subpixel according to the invention.

DETAILED DESCRIPTION

In the following detailed description of the preferred embodiments, reference is made to the accompanying drawings which form a part hereof, and in which is shown by way of illustration specific embodiments in which the invention may be practiced.

Figure 1:
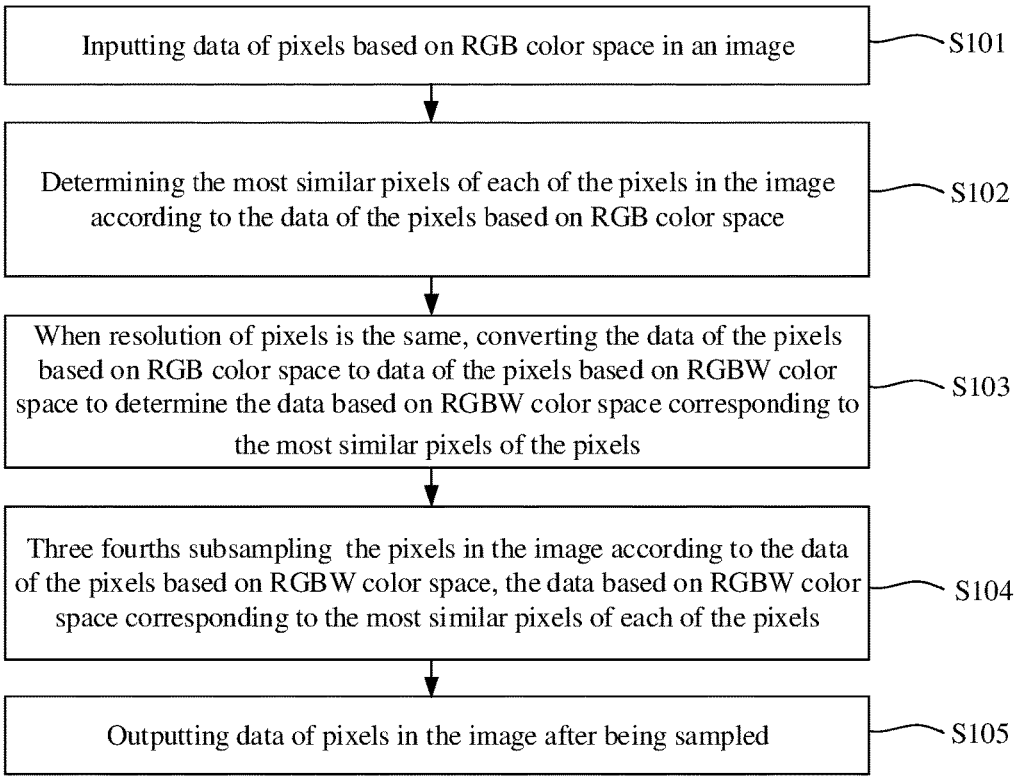
FIG. 1 is a flow chart of an offset method of a RGBW panel subpixel according to a first exemplary embodiment of the invention.

Referring to FIG. 1, which is a flow chart of an offset method of a RGBW panel subpixel according to an exemplary embodiment of the invention, including:

Step S101: inputting data of pixels based on RGB color space in an image.

Step S102: determining the most similar pixels of each of the pixels in the image according to the data of the pixels based on RGB color space.

There are numerous methods to determination the similarity among pixels in an image according to conventional technology, for example: a conventional method to calculate the similarity of pixels, a method to calculate the similarity of pixels of spectrum cluster image segmentation, etc., the similarity of central pixels and surrounding pixels can be calculated according to the methods, the most similar pixel compared with central pixels can be determined by comparing the similarity, the pixel with the most similarity is the most similar pixel of the central pixels, the most similar pixel of each pixel in an image can be determined correspondingly.

Step S103: under a circumstance that resolution of pixels is the same, converting the data of the pixels based on RGB color space to data of the pixels based on RGBW color space, for determining the data based on RGBW color space corresponding to the most similar pixels of the pixels.

Same resolution of pixels means the number, size and dimension of each subpixel are all the same in RGB color space and RGBW color space.

In conventional technique, a number of methods can convert data of pixels based on RGB color space to data of pixels based on RGBW color space, for example: methods to extract red-green-blue-white signals from red-green-blue signals in conventional technique.

When resolution of pixels is the same, data of pixels based on RGB color space is converted to data of pixels based on RGBW color space by a conventional method, as the most similar pixel of pixels is pre-determined, data based on RGBW color space corresponding to the most similar pixel of pixels can be discovered accordingly.

For example, the most similar pixel of a pixel 11 is a pixel 21, data of the pixel 21 based on RGBW color space can be discovered. Without uncertainty, during operation, data of RGBW color space based on the most similar pixel 21 of the pixel 11 can be re-converted to data of the pixel 21 based on RGBW color space, details in completing the process have no barriers.

Step S104: sub sampling three fourths of the pixels in the image according to the data of the pixels based on RGBW color space, the data based on RGBW color space corresponding to the most similar pixels of each of the pixels.

Subsample points to sample in a certain interval, a new sample achieved is a subsample of the original sample.

Some method for three fourths subsampling pixels in an image according to conventional technique merely employs ¾ interpolation of the entire pixels, which means only data of pixels based on RGBW color space is referred; besides considering data of pixels based on RGBW color space, influence of adjacent pixels is the only factor to be included, however, influence of horizontally adjacent cannot represent the real influence in application. In exemplary embodiments of the invention, data of pixels based on RGBW color space and data based on RGBW color space corresponding to the most similar pixel of each pixel are both in reference during three fourths subsampling pixels in an image, which means influence of the most similar pixel of each pixel on the pixel, in conventional technique, only considering data of pixels based on RGBW color space and data based on RGBW color space corresponding to the most similar pixel of each pixel is enough to three fourths subsample pixels in an image. More details group no limits.

Since the most similar pixel of the pixel and the pixel are alike, influence of the most similar pixel of the pixel on the pixel approaches to the influence in reality, therefore, resolution loss and jagged edges when subsampling the entire pixels can be mostly conquered.

Step S105: outputting data of pixels in the image after being sampled.

As the most similar pixel of each of the pixels in an image is pre-determined according to exemplary embodiments of the invention, when pixels in an image are three fourths subsampled, influence of data of pixels based on RGBW color space and data based on RGBW color space corresponding to the most similar pixel of each pixel should be considered, therefore, resolution loss and jagged edges when subsampling the entire pixels can be mostly conquered.

Figure 2:
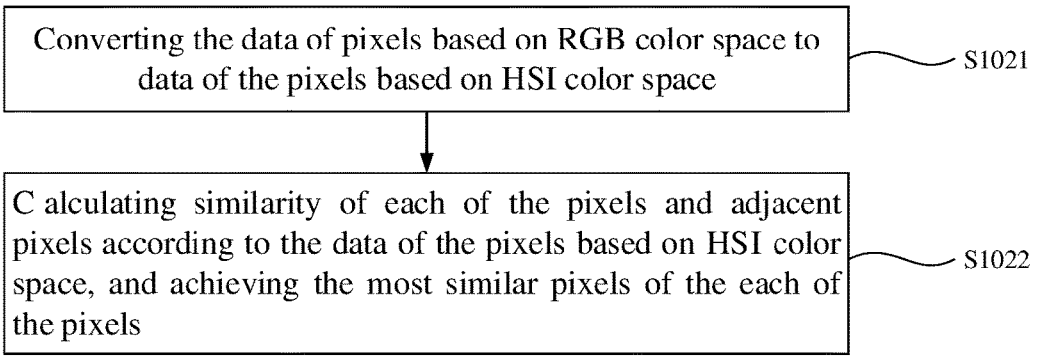
FIG. 2 is a flow chart of an offset method of a RGBW panel subpixel according to a second exemplary embodiment of the invention.

Referring to FIG. 2, the step S102 can include: a sub step S1021 and a sub step S1022.

Sub step S1021: converting the data of pixels based on RGB color space to data of the pixels based on HSI color space.

Sub step S1022: calculating similarity of each of the pixels and adjacent pixels according to the data of the pixels based on HIS color space, and achieving the most similar pixels of the each of the pixels.

Hue Saturation Intensity (HSI) color space or color model is characterized by H, S and I as color, where H defines wavelength of the color and is named hue; S represents saturation of the color and is named saturation; I is intensity or lightness. A color of an object is described in hue, saturation and intensity when observed. Hue describes property of a pure color, saturation measures the extent of a pure color diluted by a white light, intensity is a subjective description, actually which is not able to be measured, and gives conception of colorless intensity, intensity is a vital parameter to describe a color, intensity is the most useful factor in description of a monochromatic image, which is measurable and easily explained. The module can remove intensity from colored information in a color image, making the HSI model to become a useful tool to develop a method of analyzing images based on color description, the color description is apparent to people.

Data of pixels based on RGB color space is converted to data of pixels based on HSI color space, then the similarity of each pixel in HSI color space and 8 surrounding pixels is calculated, the pixel with the most similarity compared with the pixel is the most similar pixel of the pixel.

The similarity among pixels is measured by the HSI color space, as the color description with help of the HSI color model is apparent to people, therefore, the calculation of the most similar pixels of pixels approach to the reality, color distortion of pixels caused by subsample can be decreased.

Figure 3:
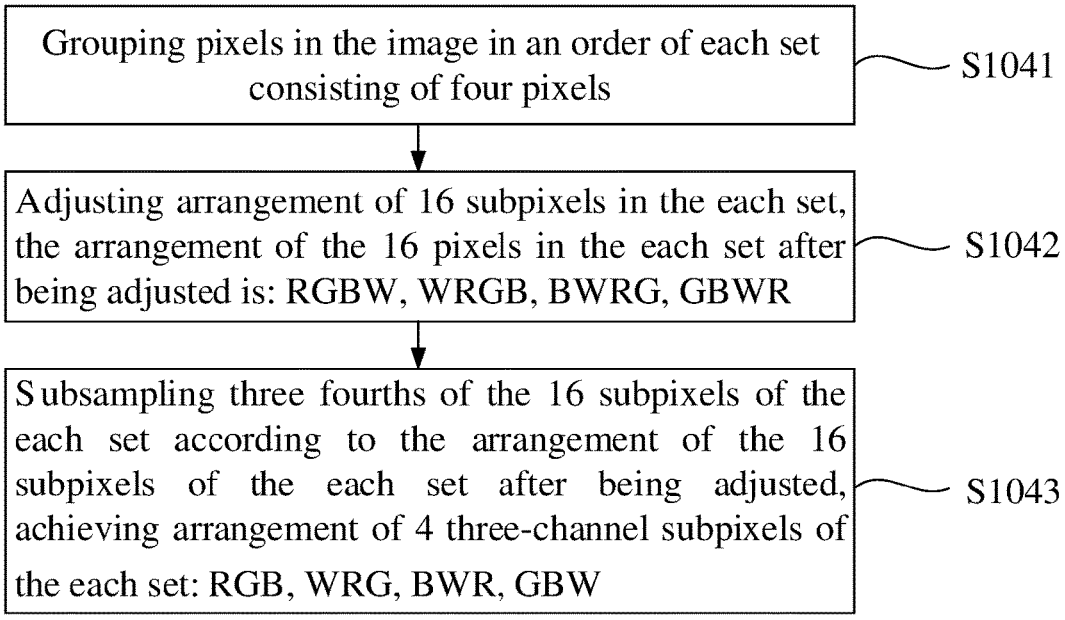
FIG. 3 is a flow chart of an offset method of a RGBW panel subpixel according to a third exemplary embodiment of the invention.

Referring to FIG. 3, step S104 can include: a sub step S1041, a sub step S1042 and a sub step S1043.

Sub step S1041: In RGBW color space, grouping pixels in the image in an order of each group consisting of four pixels.

Sub step S1042: adjusting arrangement of 16 subpixels in the each group, the arrangement of the 16 pixels in the each group after being adjusted is: RGBW, WRGB, BWRG, GBWR.

Figure 4:
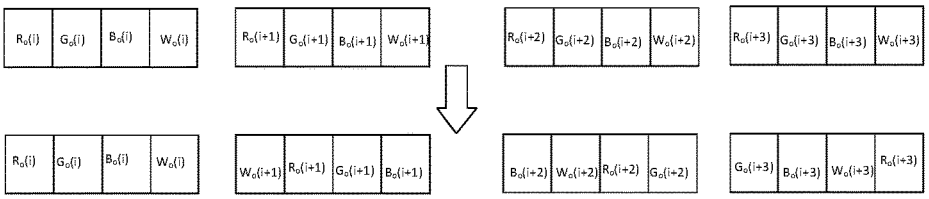
FIG. 4 is a schematic view of pixels after being grouped and subpixels after arrangement in the method of offsetting a RGBW panel subpixel according to the invention.

Grouping and arrangement after being adjusted in step S1041 and step S1042 refer to FIG. 4. Four pixels grouped in one group are i,i+1, i+2 and i+3 respectively, before adjustment, a sequence of 16 subpixels in the four pixels i,i+1, i+2 and i+3 is RGBW, RGBW, RGBW, RGBW, a sequence of the 16 subpixels after adjustment is: RGBW, WRGB, BWRG, GBWR.

Sub step S1043: sub sampling three fourths of the 16 subpixels of the each group according to the arrangement of the 16 subpixels of the each group after being adjusted, achieving arrangement of 4 three-channel subpixels of the each group: RGB, WRG, BWR, GBW, when the pixel i is RGBW, a strategy for sampling is:

$$R_d(i) = P_r(i)$$

$$G_d(i) = G_o(i)$$

$$B_d(i) = B_o(i),$$

when the pixel i is WRGB, a strategy for sampling is:

$$W_d(i) = P_w(i)$$

$$R_d(i) = R_o(i)$$

$$G_d(i) = G_o(i),$$

when the pixel i is BWRG, a strategy for sampling is:

$$B_d(i) = P_b(i)$$

$$W_d(i) = W_o(i)$$

$$R_d(i) = R_o(i),$$

when the pixel i is GBWR, a strategy for sampling is:

$$G_d(i) = P_g(i)$$

$$B_d(i) = B_o(i)$$

$$W_d(i) = W_o(i),$$

$R_d(i)$, $G_d(i)$, $B_d(i)$ and $W_d(i)$ are respectively grey values of the pixel i based on four channels RGBW on RGBW color space after being sampled, $R_o(i)$, $G_o(i)$, $B_o(i)$ and $W_o(i)$ are respectively grey values of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on the RGBW color space corresponding to the most similar pixel of the pixel i, $R_o(i-1)$, $G_o(i-1)$, $B_o(i-1)$ and $W_o(i-1)$ are grey levels of the RGBW four channels on the RGBW color space based on the pixel i−1 before being sampled.

For example, $P_r(i)$ is an average value of a sum of $R_s(i)$, $R_o(i)$ and $R_o(i-1)$, or an average value of a sum after being weighted etc., $P_w(i)$ is an average value of a sum of $W_s(i)$, $W_o(i)$ and $W_o(i-1)$, or an average value of a sum after being weighted etc., $P_b(i)$ is an average value of a sum of $B_s(i)$, $B_o(i)$ and $B_o(i-1)$, or an average value of a sum after being weighted etc., $P_g(i)$ is an average value of a sum of $G_s(i)$, $G_o(i)$ and $G_o(i-1)$, or an average value of a sum after being weighted etc.

Figure 5:
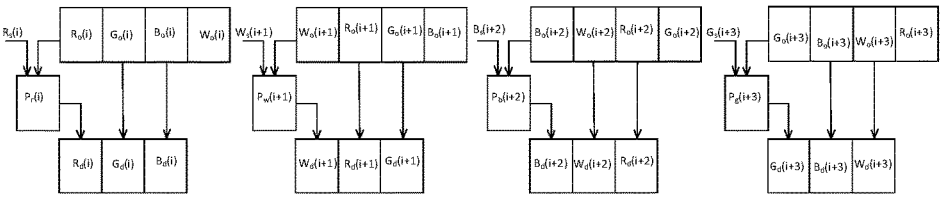
FIG. 5 is a schematic view of subsampling process in the method of offsetting a RGBW panel subpixel according to the invention.

A process of the sub step S1043 can refer to FIG. 5, four pixels grouped in one group are i, i+1, i+2 and i+3 respectively, the 16 subpixels are three fourths subsampled after adjustment, sequences of 4 three-channel subpixels in each group are: RGB, WRG, BWR and GBW, $P_r(i)$ derives from $R_s(i)$, $R_o(i)$ and $R_o(i-1)$, $P_w(i+1)$ derives from $W_s(i+1)$, $W_o(i+1)$ and $W_o(i)$, $P_b(i+2)$ derives from $B_s(i+2)$, $B_o(i+2)$ and $B_o(i+1)$, $P_g(i+3)$ derives from $G_s(i+3)$, $G_o(i+3)$ and $G_o(i+2)$.

$P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1)),$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$ $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

In other words, in the exemplary embodiment, $P_r(i)$ is the maximum grey level among $R_s(i)$, $R_o(i)$ and $R_o(i-1)$, $P_w(i)$ is the maximum grey level among $W_s(i)$, $W_o(i)$ and $W_o(i-1)$, $P_b(i)$ is the maximum grey level among $B_s(i)$, $B_o(i)$ and $B_o(i-1)$, $P_g(i)$ is the maximum grey level among $G_s(i)$, $G_o(i)$ and $G_o(i-1)$.

$P_r(i)$, $P_b(i)$, $P_b(i)$ and $P_g(i)$ are maximum values respectively, therefore, difference of edge pixels and other pixels can be preserved ultimately to increase resolution and decrease loss of image details.

Figure 6:
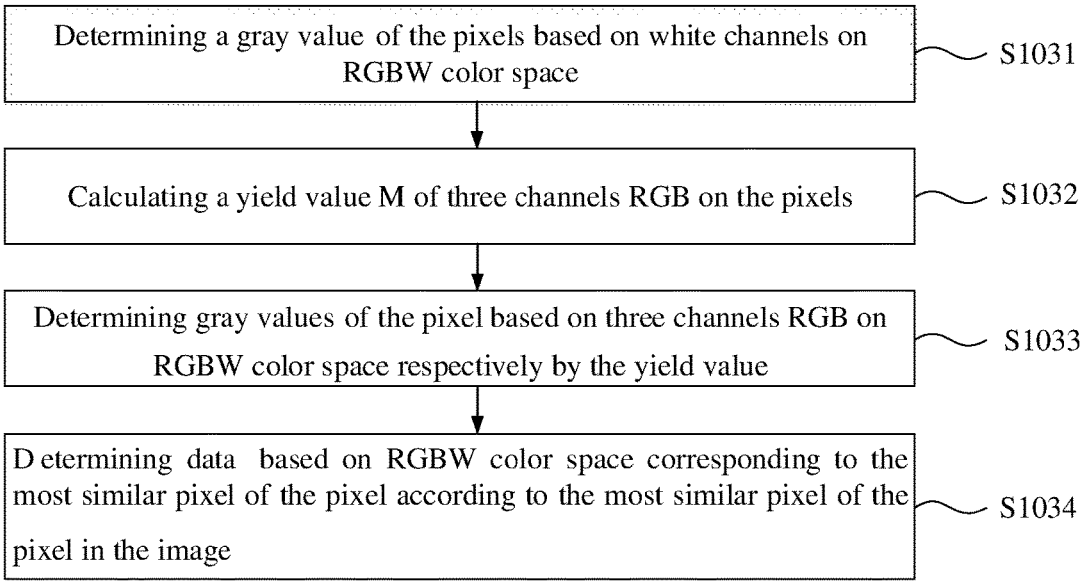
FIG. 6 is a schematic view of an offset method of a RGBW panel subpixel according to a second exemplary embodiment of the invention.

Referring to FIG. 6, step S103 can include: a sub step S1031, a sub step S1032, a sub step S1033 and a sub step S1034.

Sub step S1031: determining a grey level $W_o(i)$ of the pixels based on white channels on RGBW color space, where $W_o(i)=D_{min}(i)$, i is a position of the pixel, $D_{min}(i)$ is the minimum value of grey levels of the pixel i based on three channels RGB on RGB color space.

Sub step S1032: calculating a yield value M of three channels RGB on the pixels, where $$M = \frac{(W_o(i) + D_{max}(i))}{D_{max}(i)},$$

$D_{max}(i)$ is the maximum value of grey levels of the pixel i based on three channels RGB on RGB color space.

Sub step S1033: determining grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i),$$

$$B_o(i)=B(i)\times M-W_o(i)$$

R(i), G(i) and B(i) are grey levels of the pixel based on three channels RGB on RGB color space.

Sub step S1034: determining data $R_s(i)$, $G_s(i)$, $B_s(i)$ and $W_s(i)$ based on RGBW color space corresponding to the most similar pixel of the pixel according to the most similar pixel of the pixel in the image.

The invention can overcome loss of color gradation and fine strips of a strip RGBW panel caused by interpolation in a method referred to the paper (Kwon K J, Kim Y H. Scene-adaptive RGB-to-RGBW conversion using retinex theory-based color preservation [J]. Display Technology, Journal of, 2012, 8(12): 684-694.). To test the effectiveness of the invention, three groups of comparison images is employed to illustrate, the results are shown in FIG. 7*a*, FIG. 7*b*, FIG. 7*c*, FIG. 8*a*, FIG. 8*b*, FIG. 8*c*, FIG. 9*a*, FIG. 9*b* and FIG. 9*c* (note: the image is originally colored and processed to be hoary).

Figure 7A:
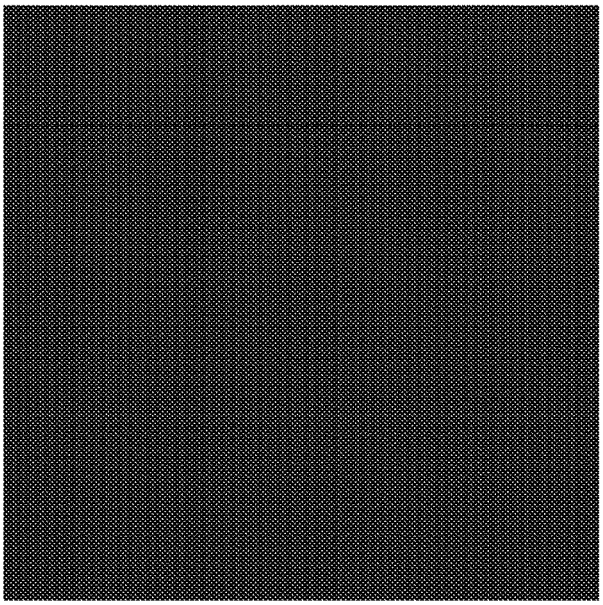
FIG. 7*a* is an image shown RGB original blue vertical stripes.
Figure 7B:
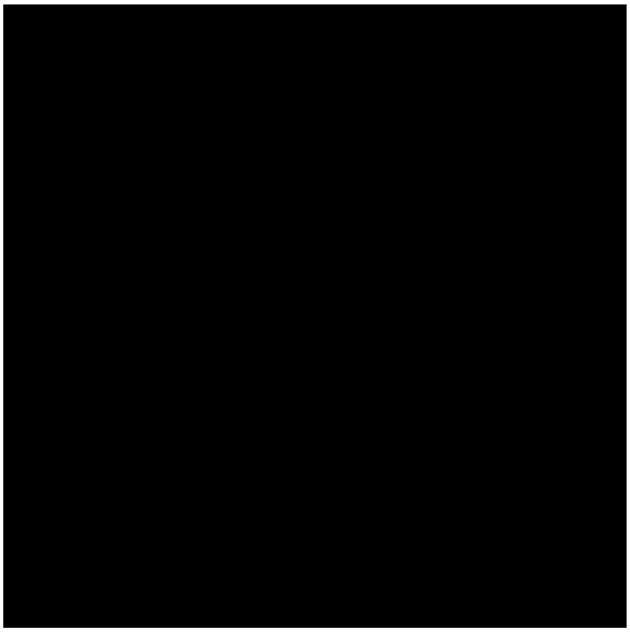
FIG. 7*b* is a RGBW image achieved by interpolation according to the method in the reference.
Figure 7C:
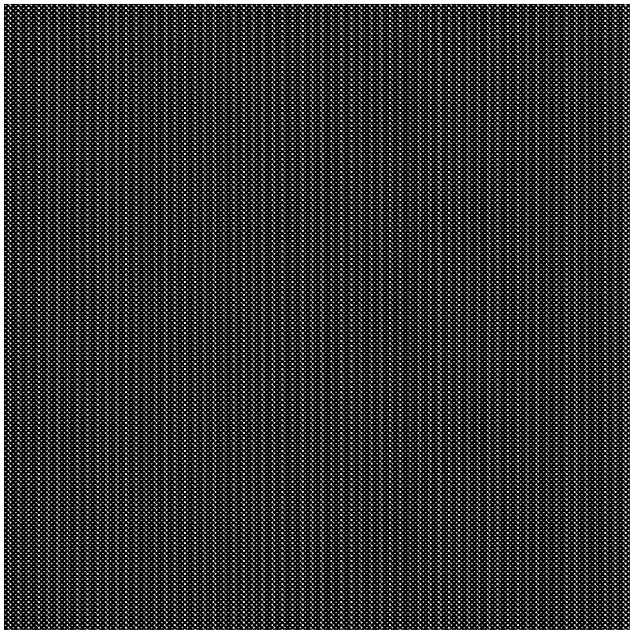
FIG. 7*c* is a RGBW image achieved by interpolation according to the present method.
Figure 8A:
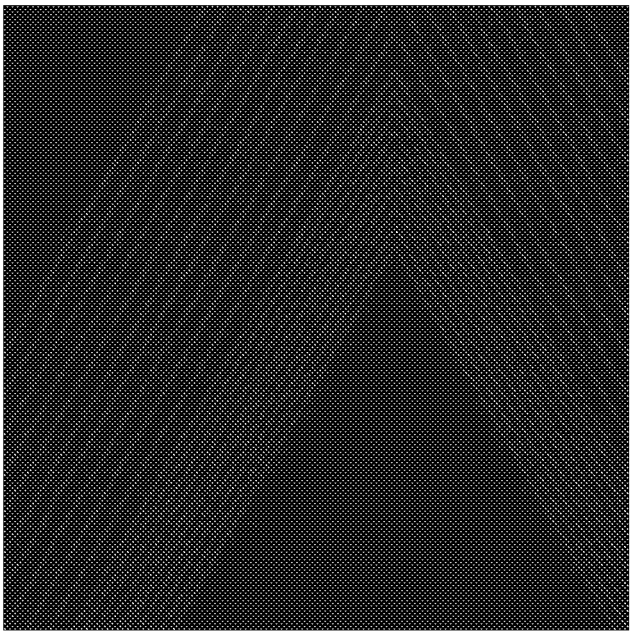
FIG. 8*a* is an image shown RGB original blue oblique stripes.
Figure 8B:
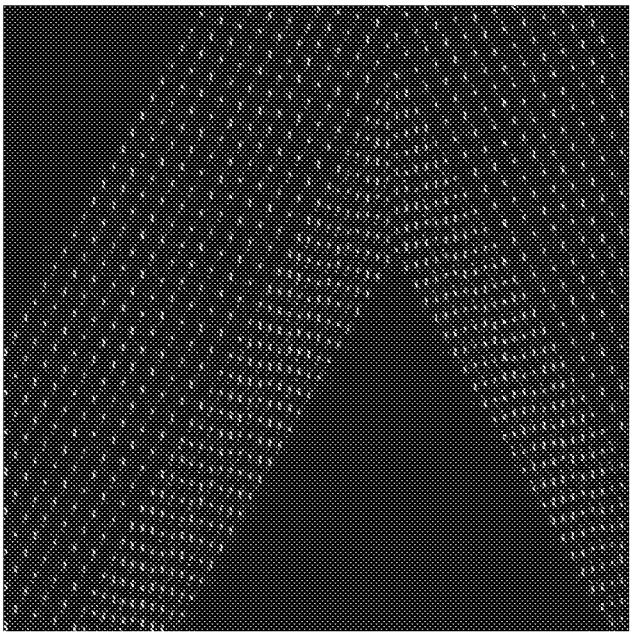
FIG. 8*b* is a RGBW image achieved by interpolation according to the method in the reference.
Figure 8C:
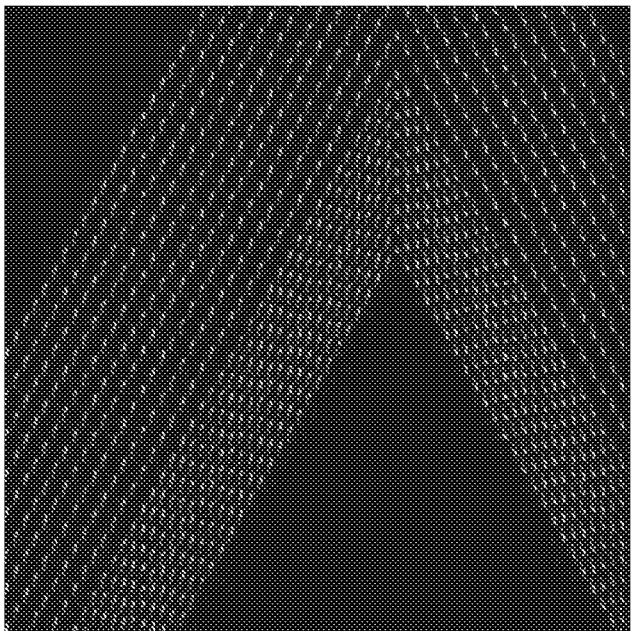
FIG. 8*c* is a RGBW image achieved by interpolation according to the present method.
Figure 9A:
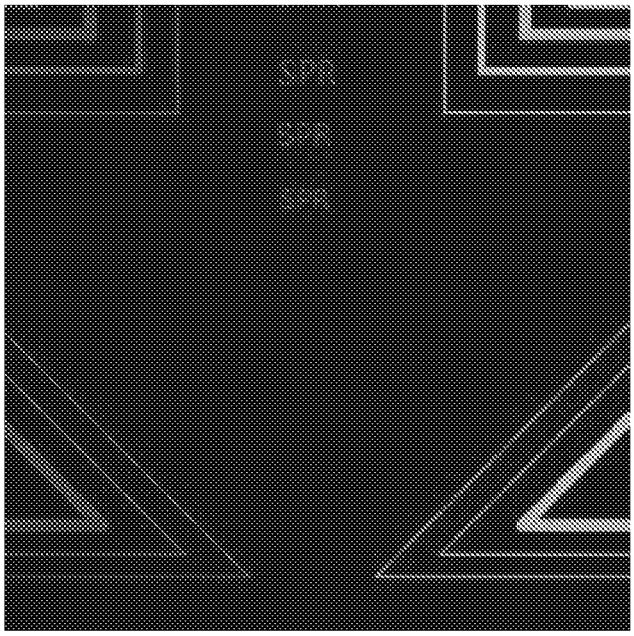
FIG. 9*a* is a RGB original colored image.
Figure 9B:
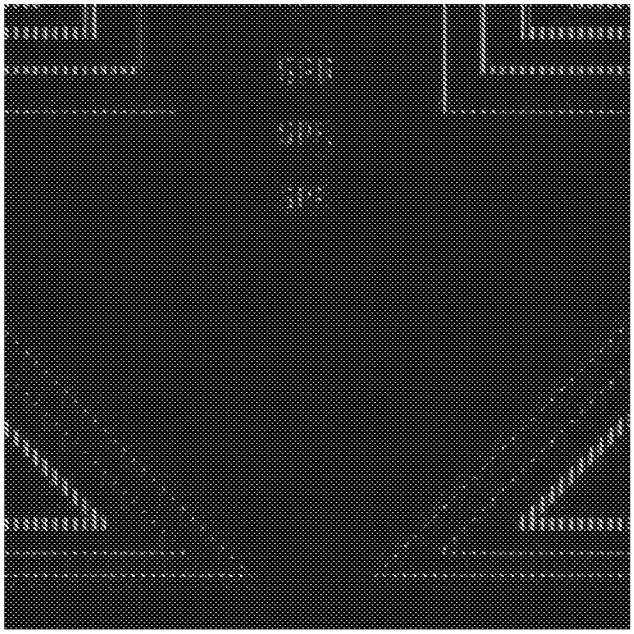
FIG. 9*b* is a RGBW image achieved by interpolation according to the method in the reference.
Figure 9C:
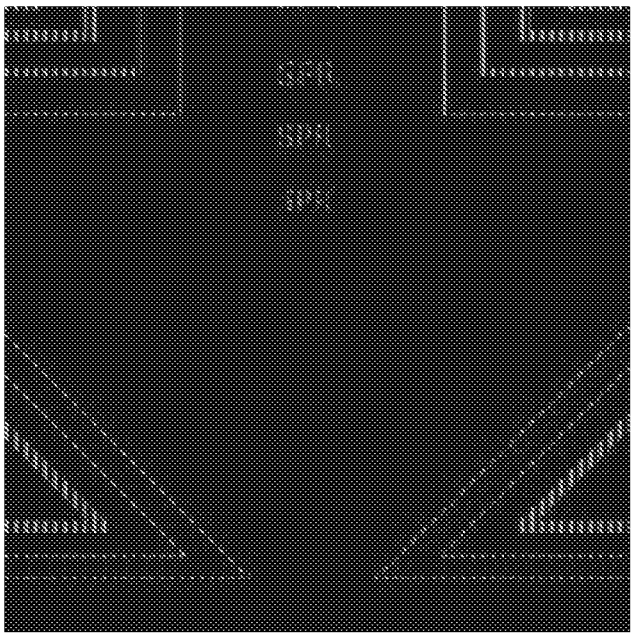
FIG. 9*c* is a RGBW image achieved by interpolation according to the present method.

FIG. 7*a* is a RGB original blue vertical stripe image, the resolution is 256*256; FIG. 7*b* is a RGBW image interpolated from the method in the reference, the resolution is 256*256 (strips in the figure is lost); FIG. 7*c* is a RGBW image interpolated from the invention, the resolution is 256*256 (strips in the figure shift one pixel without loss). FIG. 8*a* is a RGB original blue oblique strip image, the resolution is 256*256; FIG. 8*b* is a RGBW image interpolated from the method in the reference, the resolution is 256*256 (strips in the figure is broken); FIG. 8*c* is a RGBW image interpolated from the invention, the resolution is 256*256. FIG. 9*a* is a RGB original colored image, the resolution is 256*256, FIG. 9*b* is a RGBW image interpolated from the method in the reference, the resolution is 256*256 (strips in the figure are lost or broken); FIG. 9*c* is a RGBW image interpolated from the invention, the resolution is 256*256.

The RGBW images interpolated from the method in the reference as shown in FIG. 7*b*, FIG. 8*b* and FIG. 9*b* can be distortion and broken, or even lost when display monochromatic strips; the RGBW images interpolated from the invention as shown in FIG. 7*c*, FIG. 8*c* and FIG. 9*c* can avoid the previous problems and reserve more information.

Figure 10:
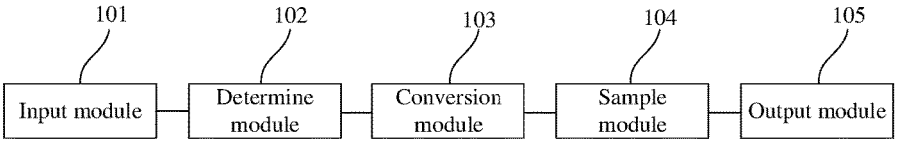
FIG. 10 is a schematic structural view of an offset equipment of a RGBW panel subpixel according to a first exemplary embodiment of the invention.

Referring to FIG. 10, FIG. 10 is a schematic structural view of an offset equipment of a RGBW panel subpixel according to a first exemplary embodiment of the invention, the equipment can execute the sequence of the method above, which can refer to the description above.

The equipment includes: an input module 101, a determination module 102, a conversion module 103, a sample module 104 and an output module 105.

The input module 101 is applied to input data of pixels in an image based on RGB color space.

The determination module 102 is applied to determination the most similar pixels of each of the pixels in the image according to data of the pixels based on RGB color space.

The conversion module 103 is applied to transform data of the pixels based on RGB color space to data of pixel based on RGBW color space, and determining data based on RGBW color space corresponding to the most similar pixels of the pixels.

The sample module 104 is applied to three fourths subsample pixels in the image according to data of the pixels based on RGBW color space, data based on RGBW color space corresponding to the most similar pixels of each of the pixels.

The output module 105 is applied to output data of pixels in the image after being sampled.

The most similar pixels of each of the pixels in an image are pre-determined according to the invention, when pixels in an image are three fourths subsampled, influence factors include data of pixels based on RGBW color space as well as data based on RGBW color space corresponding to the most similar pixels of each of pixels are both considered, therefore, resolution loss and jagged edges can be fixed accordingly.

Figure 11:
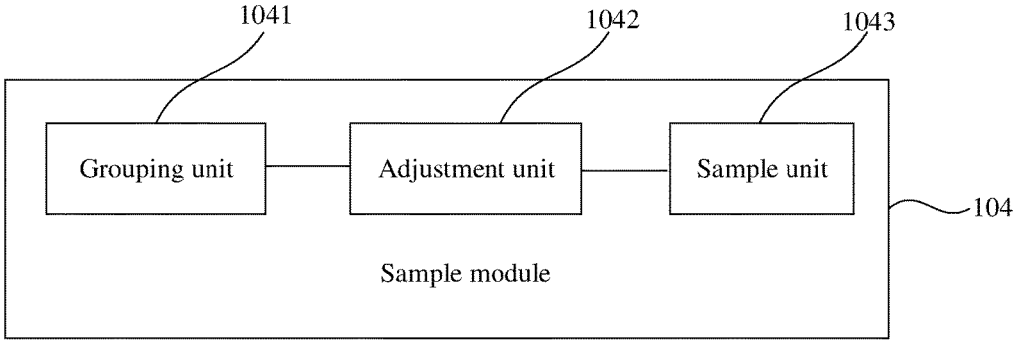
FIG. 11 is a schematic structural view of an offset method of a RGBW panel subpixel according to a second exemplary embodiment of the invention.

Referring to FIG. 11, the determination module 102 includes: a conversion unit 1021 and a first calculation unit 1022.

The conversion unit 1021 is applied to transform data of the pixels based on RGB color space to data of the pixels based on HSI color space.

The first calculation unit is applied to calculate similarity of each of the pixels and adjacent pixels according to the data of the pixels based on HSI color space, and achieving the most similar pixels of the each of the pixels.

Figure 12:
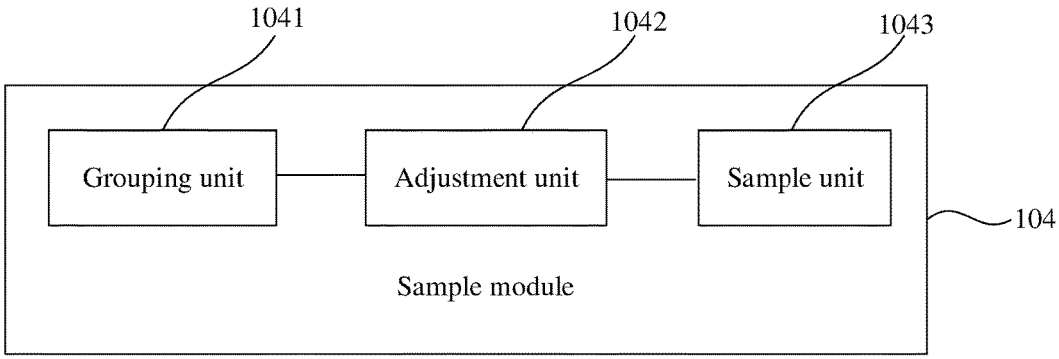
FIG. 12 is a schematic structural view of an offset method of a RGBW panel subpixel according to a third exemplary embodiment of the invention.

Referring to FIG. 12, the sample module 104 includes: a grouping unit 1041, an adjustment unit 1042 and a sample unit 1043.

The grouping unit 1041 is applied to group pixels in the image in an order of each group consisting of four pixels in the RGBW color space.

The adjustment unit is applied to adjust arrangement of 16 subpixels in the each group, the arrangement of the 16 pixels in the each group after being adjusted is: RGBW, WRGB, BWRG, GBWR.

The sample unit, applied to three fourths subsample the 16 subpixels of the each group according to the arrangement of the 16 subpixels of the each group after being adjusted, achieving arrangement of 4 three-channel subpixels of the each group: RGB, WRG, BWR, GBW, when the pixel i is RGBW, a strategy for sampling is:

$$R_d(i) = P_r(i)$$
$$G_d(i) = G_o(i)$$
$$B_d(i) = B_o(i),$$

when the pixel i is WRGB, a strategy for sampling is:

$$W_d(i) = P_w(i)$$
$$R_d(i) = R_o(i)$$
$$G_d(i) = G_o(i),$$

when the pixel i is BWRG, a strategy for sampling is:

$$B_d(i) = P_b(i)$$
$$W_d(i) = W_o(i)$$
$$R_d(i) = R_o(i),$$

when the pixel i is GBWR, a strategy for sampling is:

$$G_d(i) = P_g(i)$$
$$B_d(i) = B_o(i)$$
$$W_d(i) = W_o(i),$$

$R_d(i)$, $G_d(i)$, $B_d(i)$ and $W_d(i)$ are respectively grey values of the pixel i based on four channels RGBW on RGBW color space after being sampled, $R_o(i)$, $G_o(i)$, $B_o(i)$ and $W_o(i)$ are respectively grey values of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on the RGBW color space corresponding to the most similar pixel of the pixel i, $R_o(i-1)$, $G_o(i-1)$, $B_o(i-1)$ and $W_o(i-1)$ are grey levels of the RGBW four channels on the RGBW color space based on the pixel i−1 before being sampled.

$P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1))$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

Figure 13:
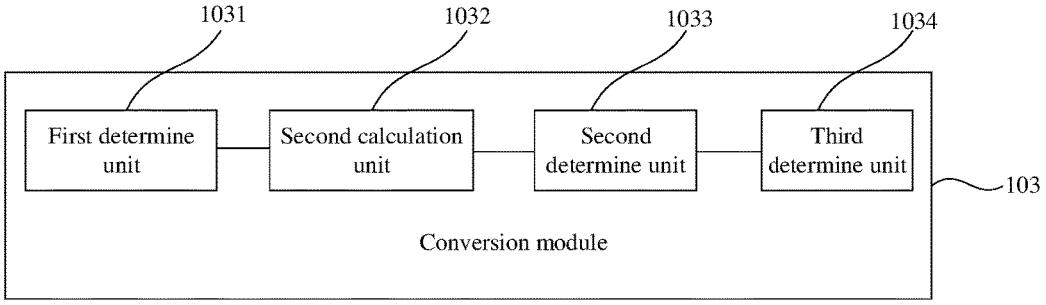
FIG. 13 is a schematic structural view of an offset method of a RGBW panel subpixel according to a fourth exemplary embodiment of the invention.

Referring to FIG. 13, the conversion module 103 includes: a determination unit 1031, a second calculation unit 1032, a second determination unit 1033 and a third determination unit 1034.

The first determination unit is applied to determination a grey level $W_o(i)$ of the pixels based on white channels on RGBW color space, where $W_o(i)=D_{min}(i)$, i is a position of the pixel, $D_{min}(i)$ is the minimum value of grey levels of the pixel i based on three channels RGB on RGB color space.

The second calculation unit, applied to calculate a yield value M of three channels RGB on the pixels, where $$M = \frac{(W_o(i) + D_{max}(i))}{D_{max}(i)},$$

$D_{max}(i)$ is the maximum value of grey levels of the pixel i based on three channels RGB on RGB color space.

The second determination unit, applied to determination grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are grey levels of the pixel based on three channels RGB on RGB color space.

The third determination unit, applied to determination data $R_s(i)$, $G_s(i)$, $B_s(i)$ and $W_{si}$) based on RGBW color space corresponding to the most similar pixel of the pixel according to the most similar pixel of the pixel in the image.

The embodiments are preferred chosen and described in order to best explain the present invention. It is not intended to be exhaustive or to limit the invention to the precise form or to exemplary embodiments disclosed. It is intended that the scope of the invention is defined by the claims appended hereto and their equivalents in which all terms are meant in their broadest reasonable sense unless otherwise indicated.

What is claimed is:

1. An offset method of a RGBW panel subpixel, comprising:

inputting data of pixels based on RGB color space in an image;

determining the most similar pixels of each of the pixels in the image according to the data of pixels based on RGB color space;

when resolution of pixels is the same, converting the data of the pixels based on RGB color space to data of the pixels based on RGBW color space, determining data based on RGBW color space corresponding to the most similar pixels of the pixels;

three fourths subsampling the pixels in the image according to the data of the pixels based on RGBW color space, the data based on RGBW color space corresponding to the most similar pixels of each of the pixels;

outputting data of pixels in the image after being sampled;

wherein the sequence of determining the most similar pixels of each of the pixels in the image according to the data of pixels based on RGB color space comprises:

converting the data of the pixels based on RGB color space to data of the pixels based on HSI color space;

calculating similarity of each of the pixels and adjacent pixels according to the data of the pixels based on HSI color space, achieving the most similar pixels of the each of the pixels;

wherein the sequence of three fourths subsampling pixels in the image according to the data of pixels based on RGBW color space, the data based on RGBW color space corresponding to the most similar pixels of each of the pixels comprises:

dividing pixels in the image in an order of each group consisting of four pixels in the RGBW color space;

adjusting arrangement of 16 subpixels in each of the groups, an arrangement of the 16 pixels in each of the groups after adjustment: RGBW, WRGB, BWRG, GBWR;

three fourths subsampling the 16 subpixels of each of the groups according to the arrangement of the 16 subpixels of each of the groups after adjustment, achieving arrangement of 4 three-channel subpixels of each of the groups: RGB, WRG, BWR, GBW, wherein when the pixel i is RGBW, a strategy for sampling is:

$$R_d(i) = P_r(i)$$

$$G_d(i) = G_o(i)$$

$$B_d(i) = B_o(i),$$

when the pixel i is WRGB, a strategy for sampling is:

$$W_d(i) = P_w(i)$$

$$R_d(i) = R_o(i)$$

$$G_d(i) = G_o(i),$$

when the pixel i is BWRG, a strategy for sampling is:

$$B_d(i) = P_b(i)$$

$$W_d(i) = W_o(i)$$

$$R_d(i) = R_o(i),$$

when the pixel i is GBWR, a strategy for sampling is:

$$G_d(i) = P_g(i)$$

$$B_d(i) = B_o(i)$$

$$W_d(i) = W_o(i),$$

$R_d(i)$, $G_d(i)$, $B_d(i)$ and $W_d(i)$ are respectively grey levels of the pixel i based on four channels RGBW on RGBW color space after being sampled, $R_o(i)$, $G_o(i)$, $B_o(i)$ and $W_o(i)$ are respectively grey levels of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on the RGBW color space corresponding to the most similar pixel of the pixel i, $R_o(i-1)$, $G_o(i-1)$, $B_o(i-1)$ and $W_o(i-1)$ are grey levels of the RGBW four channels on the RGBW color space based on the pixel i−1 before being sampled.

2. The method according to claim 1, wherein the $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1))$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

3. The method according to claim 1, wherein when the resolution of pixels is the same, the sequence that converts the data of the pixels based on data of RGB color space to the data of the pixels based on RGBW color space to determine the data of the most similar pixels of the pixels corresponding to RGBW color space comprises:

determining a grey level $W_o(i)$ of the pixels based on white channels on RGBW color space, where $W_o(i)=D_{min}(i)$, i is a position of the pixel, $D_{min}(i)$ is the minimum value of grey levels of the pixel i based on three channels RGB on RGB color space;

calculating a yield value M of three channels RGB on the pixels, where $$M=\frac{(W_o(i)+D_{max}(i))}{D_{max}(i)},$$

$D_{max}(i)$ is the maximum value of grey levels of the pixel i based on three channels RGB on RGB color space;

determining grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are grey levels of the pixel based on three channels RGB on RGB color space;

determining data $R_s(i)$, $G_s(i)$, $B_s(i)$ and $W_s(i)$ based on RGBW color space corresponding to the most similar pixel of the pixel according to the most similar pixel of the pixel in the image.

4. An offset method of a RGBW panel subpixel, comprising:

inputting data of pixels based on RGB color space in an image;

determining the most similar pixels of each of the pixels in the image according to the data of the pixels based on RGB color space;

when the resolution of pixels is the same, converting the data of the pixels based on RGB color space to data of the pixels based on RGBW color space; for determining the data based on RGBW color space corresponding to the most similar pixels of the pixels;

three fourths subsampling the pixels in the image according to the data of the pixels based on RGBW color space, the data based on RGBW color space corresponding to the most similar pixels of each of the pixels;

outputting data of pixels in the image after being sampled;

wherein the sequence of three fourths subsampling pixels in the image according to the data of pixels based on RGBW color space, the data based on RGBW color space corresponding to the most similar pixels of the pixels comprises:

dividing pixels in the image in an order of each group consisting of four pixels;

adjusting arrangement of 16 subpixels in each of the groups, the arrangement of the 16 pixels in each of the groups after adjustment is: RGBW, WRGB, BWRG, GBWR;

three fourths subsampling the 16 subpixels of each of the groups according to the arrangement of the 16 subpixels of each of the groups after adjustment, achieving arrangement of 4 three-channel subpixels of each of the groups: RGB, WRG, BWR, GBW, wherein when the pixel i is RGBW, a strategy for sampling is:

$$R_d(i)=P_r(i)$$

$$G_d(i)=G_o(i)$$

$$B_d(i)=B_o(i),$$

when the pixel i is WRGB, a strategy for sampling is:

$$W_d(i)=P_w(i)$$

$$R_d(i)=R_o(i)$$

$$G_d(i)=G_o(i),$$

when the pixel i is BWRG, a strategy for sampling is:

$$B_d(i)=P_b(i)$$

$$W_d(i)=W_o(i)$$

$$R_d(i)=R_o(i),$$

when the pixel i is GBWR, a strategy for sampling is:

$$G_d(i)=P_g(i)$$

$$B_d(i)=B_o(i)$$

$$W_d(i)=W_o(i),$$

$R_d(i)$, $G_d(i)$, $B_d(i)$ and $W_d(i)$ are respectively grey values of the pixel i based on four channels RGBW on RGBW color space after being sampled, $R_o(i)$, $G_o(i)$, $B_o(i)$ and $W_o(i)$ are respectively grey values of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on the RGBW color space corresponding to the most similar pixel of the pixel i, $R_o(i-1)$, $G_o(i-1)$, $B_o(i-1)$ and $W_o(i-1)$ are grey levels of the RGBW four channels on the RGBW color space based on the pixel i−1 before being sampled.

5. The method according to claim 4, wherein a sequence of determining the most similar pixels of each of the pixels in the image according to the data of pixels based on RGB color space comprises:

converting the data of pixels based on RGB color space to data of the pixels based on HSI color space;

calculating similarity of each of the pixels and adjacent pixels according to the data of the pixels based on HSI color space, and achieving the most similar pixels of the each of the pixels.

6. The method according to claim 4, wherein the $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1))$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

7. The method according to claim 4, wherein when the resolution of pixels is the same, the sequence that converts data of the pixels based on data of RGB color space to data of the pixels based on RGBW color space to determine data of the most similar pixels of the pixels corresponding to RGBW color space comprises:

determining a grey level $W_o(i)$ of the pixels based on white channels on RGBW color space, wherein $W_o(i)=D_{min}(i)$, i is a position of the pixel, $D_{min}(i)$ is the minimum value of grey levels of the pixel i based on three channels RGB on RGB color space;

calculating a yield value M of three channels RGB on the pixels, wherein $$M = \frac{(W_o(i) + D_{max}(i))}{D_{max}(i)},$$

$D_{max}(i)$ is the maximum value of grey levels of the pixel i based on three channels RGB on RGB color space;

determining grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i)$$

$$B_o(i)=B(i)\times M-W_o(i)$$

R(i), G(i) and B(i) are grey levels of the pixel based on three channels RGB on RGB color space;

determining data $R_s(i)$, $G_s(i)$, $B_s(i)$ and $W_s(i)$ based on RGBW color space corresponding to the most similar pixel of the pixel according to the most similar pixel of the pixel in the image.

8. An offset equipment of a RGBW panel subpixel, wherein the equipment comprises:

an input module, applied to input data of pixels in an image based on RGB color space;

a determination module, applied to determine the most similar pixels of each of the pixels in the image according to data of the pixels based on RGB color space;

a conversion module, applied to convert data of the pixels based on RGB color space to data of pixel based on RGBW color space to determine data based on RGBW color space corresponding to the most similar pixels of the pixels;

a sample module, applied to subsample three fourths of pixels in the image according to data of the pixels based on RGBW color space, data based on RGBW color space corresponding to the most similar pixels of each of the pixels;

an output module, applied to output data of pixels in the image after being sampled;

wherein the sample module comprises:

a grouping unit, applied to group pixels in the image in an order of each group consisting of four pixels in the RGBW color space;

an adjustment unit, applied to adjust arrangement of 16 subpixels in each of the groups, the arrangement of the 16 pixels in the each of the groups after adjustment is: RGBW, WRGB, BWRG, GBWR;

a sample unit, applied to subsample three fourths of the 16 subpixels of the each group according to the arrangement of the 16 subpixels of the each group after adjustment to achieve arrangement of 4 three-channel subpixels of the each group: RGB, WRG, BWR, GBW, wherein when the pixel i is RGBW, a strategy for sampling is:

$$R_d(i) = P_r(i)$$

$$G_d(i) = G_o(i)$$

$$B_d(i) = B_o(i),$$

when the pixel i is WRGB, a strategy for sampling is:

$$W_d(i) = P_w(i)$$

$$R_d(i) = R_o(i)$$

$$G_d(i) = G_o(i),$$

when the pixel i is BWRG, a strategy for sampling is:

$$B_d(i) = P_b(i)$$

$$W_d(i) = W_o(i)$$

$$R_d(i) = R_o(i),$$

when the pixel i is GBWR, a strategy for sampling is:

$$G_d(i) = P_g(i)$$

$$B_d(i) = B_o(i)$$

$$W_d(i) = W_o(i),$$

$R_d(i)$ $G_d(i)$, $B_d(i)$ and $W_d(i)$ are respectively grey levels of the pixel i based on four channels RGBW on RGBW color space after being sampled, $R_o(i)$ $G_o(i)$, $B_o(i)$ and $W_o(i)$ are respectively grey levels of the pixel i based on four channels RGBW on RGBW color space before being sampled, $P_r(i)$ is achieved according to $R_s(i)$, $R_o(i)$ and $R_o(i-1)$, $P_w(i)$ is achieved according to $W_s(i)$, $W_o(i)$ and $W_o(i-1)$, $P_b(i)$ is achieved according to $B_s(i)$, $B_o(i)$ and $B_o(i-1)$, $P_g(i)$ is achieved according to $G_s(i)$, $G_o(i)$ and $G_o(i-1)$, $R_s(i)$, $G_s(i)$, $B_s(i)$ and $W_s(i)$ are grey levels of the RGBW four channels on the RGBW color space corresponding to the most similar pixel of the pixel i, $R_o(i-1)$, $G_o(i-1)$, $B(i-1)$ and $W_o(i-1)$ are grey levels of the RGBW four channels on the RGBW color space based on the pixel i−1 before being sampled.

9. The equipment according to claim 8, wherein the determination module comprises:

a conversion unit, applied to conversion data of the pixels based on RGB color space to data of the pixels based on HSI color space;

a first calculation unit, applied to calculate similarity of each of the pixels and adjacent pixels according to the data of the pixels based on HSI color space to achieve the most similar pixels of the each of the pixels.

10. The equipment according to claim 8, wherein the $P_r(i)$, $P_w(i)$, $P_b(i)$ and $P_g(i)$ are determined by a formula 1, the formula 1 is:

$$P_r(i)=\max(R_s(i),R_o(i),R_o(i-1))$$

$$P_w(i)=\max(W_s(i),W_o(i),W_o(i-1)),$$

$$P_b(i)=\max(B_s(i),B_o(i),B_o(i-1))$$

$$P_g(i)=\max(G_s(i),G_o(i),G_o(i-1))$$

$\max(R_s(i), R_o(i), R_o(i-1))$ is the maximum value in $R_s(i)$, $R_o(i)$ and $R_o(i-1)$, $\max(W_s(i), W_o(i), W_o(i-1))$ is the maximum value in $W_s(i)$, $W_o(i)$ and $W_o(i-1)$, $\max(B_s(i), B_o(i), B_o(i-1))$ is the maximum value in $B_s(i)$, $B_o(i)$ and $B_o(i-1)$, $\max(G_s(i), G_o(i), G_o(i-1))$ is the maximum value in $G_s(i)$, $G_o(i)$ and $G_o(i-1)$.

11. The equipment according to claim 8, wherein the conversion module comprises:

a first determination unit, applied to determine a grey level $W_o(i)$ of the pixels based on white channels on RGBW color space, where $W_o(i)=D_{min}(i)$, i is a position of the pixel, $D_{min}(i)$ is the minimum value of grey levels of the pixel i based on three channels RGB on RGB color space;

a second calculation unit, applied to calculate a yield value M of three channels RGB on the pixels, where $$M = \frac{(W_o(i) + D_{max}(i))}{D_{max}(i)},$$

$D_{max}(i)$ is the maximum value of grey levels of the pixel i based on three channels RGB on RGB color space;

a second determination unit, applied to determine grey levels $R_o(i)$, $G_o(i)$ and $B_o(i)$ of the pixel based on three channels RGB on RGBW color space respectively by the yield value, where $$R_o(i)=R(i)\times M-W_o(i)$$

$$G_o(i)=G(i)\times M-W_o(i),$$

$$B_o(i)=B(i)\times M-W_o(i)$$

R(i), G(i) and B(i) are grey levels of the pixel based on three channels RGB on RGB color space;

a third determination unit, applied to determine data $R_s(i)$, $G_s(i)$, $B_s(i)$ and $W_s(i)$ based on RGBW color space corresponding to the most similar pixel of the pixel according to the most similar pixel of the pixel in the image.

* * * * *